US005629758A

United States Patent [19]

Kageyama et al.

[11] Patent Number: 5,629,758

[45] Date of Patent: May 13, 1997

[54] TONER TRANSPORTING AND LOOSENING DEVICE

[75] Inventors: Toshikazu Kageyama; Hirohisa Hoshino, both of Kanagawa, Japan

[73] Assignee: Fuji Xerox Co., Ltd., Tokyo, Japan

[21] Appl. No.: 501,237

[22] Filed: Jul. 12, 1995

[30] Foreign Application Priority Data

Jul. 19, 1994 [JP] Japan ..... 6-167195

[51] Int. Cl.[6] ..... G03G 15/06

[52] U.S. Cl. ..... 399/263; 366/319

[58] Field of Search ..... 355/245, 253, 355/260; 118/653; 366/186, 194, 243, 244, 271, 279, 318, 319, 320, 321

[56] References Cited

U.S. PATENT DOCUMENTS

| | | | |
|---|---|---|---|
| 4,187,030 | 2/1980 | Godley | 366/319 |
| 4,442,789 | 4/1984 | Pirwitz | 118/653 |
| 4,707,107 | 11/1987 | Joseph | 366/320 X |
| 4,739,907 | 4/1988 | Gallant | 366/186 X |
| 4,743,936 | 5/1988 | Bares | 355/253 |
| 4,825,244 | 4/1989 | Hediger | 118/653 X |
| 4,906,104 | 3/1990 | Nishise et al. | 366/319 |
| 5,146,277 | 9/1992 | Fox et al. | 355/245 |
| 5,189,474 | 2/1993 | Miya et al. | 355/245 |

FOREIGN PATENT DOCUMENTS 61-169422 7/1986 Japan .

*Primary Examiner*—Sandra L. Brase

*Attorney, Agent, or Firm*—Finnegan, Henderson, Farabow, Garrett & Dunner, L.L.P.

[57] ABSTRACT

A device for use with a copying machine, printer or the like transports toner from a toner storage means into the developing unit of the copying machine or printer by way of a toner transporting path including a shaft with a spiral. A toner lump loosening arrangement for loosening toner lumps before delivery to the developing unit is also positioned along the toner transporting path.

10 Claims, 5 Drawing Sheets

TONER TRANSPORTING AND LOOSENING DEVICE

BACKGROUND OF THE INVENTION

The present invention, relates to a toner transporting device for transporting toner to a position just before the developing roller in a developing unit, and more particularly to a toner transporting device capable of loosening soft blocking toner lumps.

As a developing unit used in a xerographic copying machine, a printer, or the like, there is known a developing unit associated with a toner storage means. In this type of the developing unit, toner is supplied from the toner storage means into the developing unit by means of a toner transporting means. Generally, the toner transporting means consists of a toner transporting pipe, for example, which couples the toner storage means with the developing unit, a toner transporting auger which is located in a toner transporting path of the toner transporting pipe, the toner storage means, or the like.

In high temperature and high humidity conditions, when toner is transported from the toner storage means to the developing unit, toner particles attract to each other by extremely weak forces, to thereby form lumps of toner, viz., so-called soft blocking toner. To supply toner from a toner cartridge to the toner storage means, the toner cartridge is set to the copying machine. In this case, if the toner cartridge to be set is left unused for a long time, and it is set to the machine in a state that it is unsatisfactorily shaken, this soft blocking phenomenon of toner takes place.

The cohesive force of the soft blocking toner lumps is weak, and the toner lumps are fragile. However, sometimes the soft blocking toner lumps are supplied to the developing unit while not being pulverized by an agitating member of the toner storage means or the toner transporting means. The soft blocking toner lumps, after transported to the developing unit, are frequently transported to the developing roller while not being pulverized by the agitating member in the developing unit. The toner lumps thus transported appear as black dots on the developed image. The black dots greatly deteriorates the picture quality of the reproduced picture.

The picture quality deterioration problem by the soft blocking phenomenon of toner more frequently arises in the copying machine operating at high speed for image forming. The reason for this will be estimated such that in the high speed copying machine, a large amount of toner must be transported, for unit time, from the toner storage means to the developing unit, and as a result, the developing unit, the toner transporting means, and their related components are designed while placing an emphasis on the toner transporting performances. Recent tendency of a further reduction of toner particle diameter makes it easy for the soft blocking phenomenon to take place. In this respect, one will encounter with the picture quality deterioration problem more frequently.

A unique toner transporting device for preventing the toner blocking phenomenon taking place when toner is collected from the photo receptor by the cleaning unit and transferred to the developing unit is proposed by the applicant of the present patent application (Published Unexamined Japanese Patent Application No. Sho. 61-169422). In this device, a plate spring is provided at the coupling part of the toner transporting pipe with an auger in a state that the tip of the plate spring comes in contact with a spiral when the auger is turned. When the auger is turned, the plate spring is snapped with the spiral, to thereby vibrate. By making use of the vibration, the toner blocking phenomenon is prevented from taking place at the coupling part of the transport pipe, thereby ensuring a good toner transportation.

The toner transporting device with the plate spring is suitable for pulverizing large blocked toner lumps, but is unsuitable for pulverizing small toner lumps of which the diameter is several mm or smaller. The toner transporting device has such a structure that the plate spring is brought into contact with the auger spiral. Because of this structure toner is attached to the contact portion, to thereby form a lump of toner. Further, the contact of the plate spring applies a load to the. auger. This structure is disadvantageous particularly in transporting a large amount of toner.

SUMMARY OF THE INVENTION

Accordingly, an object of the present invention is to provide a toner transporting device which simply and efficiently loosens soft blocking toner lumps into toner particles without damaging the toner transporting ability in the toner transporting path continuous to a position just before the developing roll within the developing unit, to thereby prevent picture quality deterioration caused by toner lumps.

According to the present invention, there is provided a toner lump loosening means 4 for loosening soft blocking toner lumps is movably placed at a predetermined location in an outer transport path 5 continuous to a developing unit 3.

The soft blocking toner lump means small lumps of toner when toner particles attract to each other by weak cohesive forces. The diameter of the toner lump is several mm or smaller. When receiving a measure of impact, the toner lump is loosened (pulverized) into toner particles.

The toner lump loosening means may be any member if it is capable of loosening the soft blocking toner lump by a motion, for example, rotation, in the toner transporting path without damaging the toner transporting ability. The toner lump loosening means includes a loosening portion for loosening the toner lumps while being in contact with toner being transported in the toner transporting path, and a mechanical portion for moving the loosening portion. The loosening portion of the toner lump loosening means body may be provided in a path (groove like path) other than a pipe path of the toner transporting path, but at least a part of the loosening portion is preferably located in the pipe path. The mechanical portion for moving the toner lump loosening means may be constructed using the rotary shaft of the auger, for example, located in the toner transporting path or using a drive means exclusively used for the toner lump loosening means. The toner transporting path includes a path ranging from the outside to the developing unit and another path ranging from the toner supply port of the developing unit to a position just before the developing roll.

The loosening portion of the toner lump loosening means consists of an array of needle pieces. The needle pieces may be planted in the rotary shaft of an auger in the toner transporting path. An array of the thus planted needle pieces are used in place of the spiral. In the needle piece array, any particular restrictions are not imposed the selection of the number, size, and shape of needle pieces, angles of the needle pieces when these are planted, the array of the needle pieces, pitches of the arrayed needle pieces, materials of the needle pieces. The needle pieces are not limited to those pointed at the tips but any members shaped like bars. The loosening portion consisting of the needle piece array may be rotated under rotation conditions different from rotation conditions of the auger.

The loosening portion of a toner lump loosening means consists of bristles. The loosening portion consisting of bristles may be placed at a part of the toner transporting path such that it rotates in a state that the bristles are in contact with transported toner. The number of the loosening portions consisting of bristles may be properly selected. When one loosening portion is used, a contact part of the loosening portion where the bristles contact with toner is preferably provided facing the toner transporting path. Where two loosening portions are used, it is preferable that two brush rotating members are oppositely disposed so as to contact with each other. The number of the bristles of the loosening portion, the number of rotation of the bristles, and the timing of them may be properly selected.

The loosening portion of the toner lump loosening means may be a wire-like member. In this case, the wire-like member is properly shaped, and turned within the toner transporting path while contacting with toner being transported.

The loosening portion of the toner lump loosening means may be elastic molded members. In this case, properly shaped molded members made of synthetic resin or synthetic rubber are turned within the toner transporting path in a state that toner being transported is in contact with the elastically deformable molded portions.

In the present invention, toner transported to a position just before the developing roll in the developing unit through the toner transporting path is loosened by the toner lump loosening means which operates in the toner transporting path before it reaches the position just before the developing roll, and then is supplied to the developing unit. During the process of loosening the toner lumps, the toner lump loosening means does not hinder the transporting ability of toner and does not give any load to the transporting members of the toner transporting path. Accordingly, the toner lumps are loosened to disappear in the toner transporting path and do not reach the position just before the developing roll.

BRIEF DESCRIPTION OF THE DRAWINGS

FIG. 4A is an enlarged, sectional view of a key portion of the needle piece array, and FIG. 4B is a cross sectional view taken on line B—B in FIG. 4A.

DETAILED DESCRIPTION OF THE PREFERRED EMBODIMENTS

The preferred embodiment of the present invention will be described with reference to the accompanying drawings.

Figure 1:
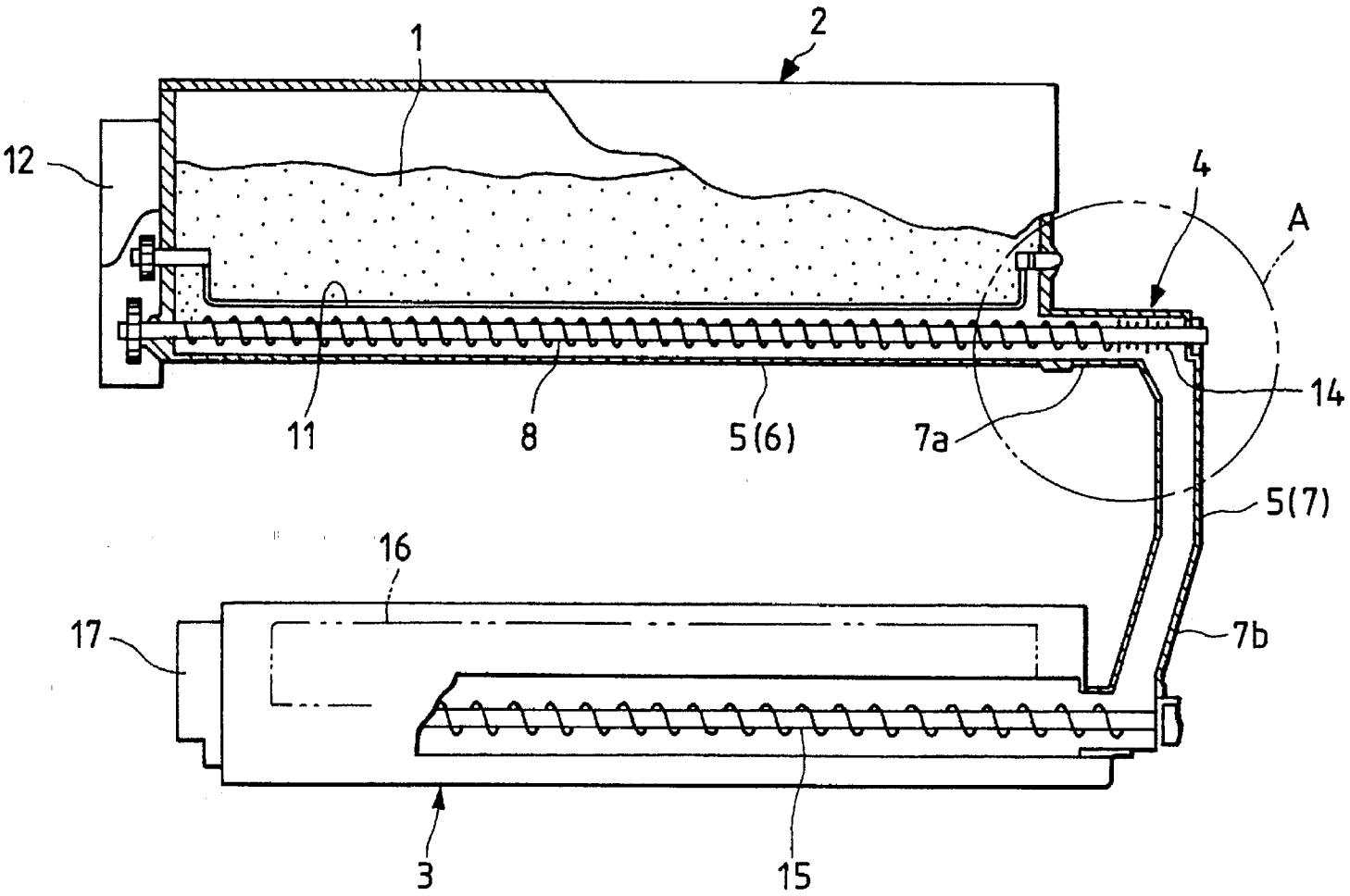
FIG. 1 is a partial cross sectional view showing a developing unit provided with a toner transporting device according to the an embodiment of the present invention.
Figure 2:
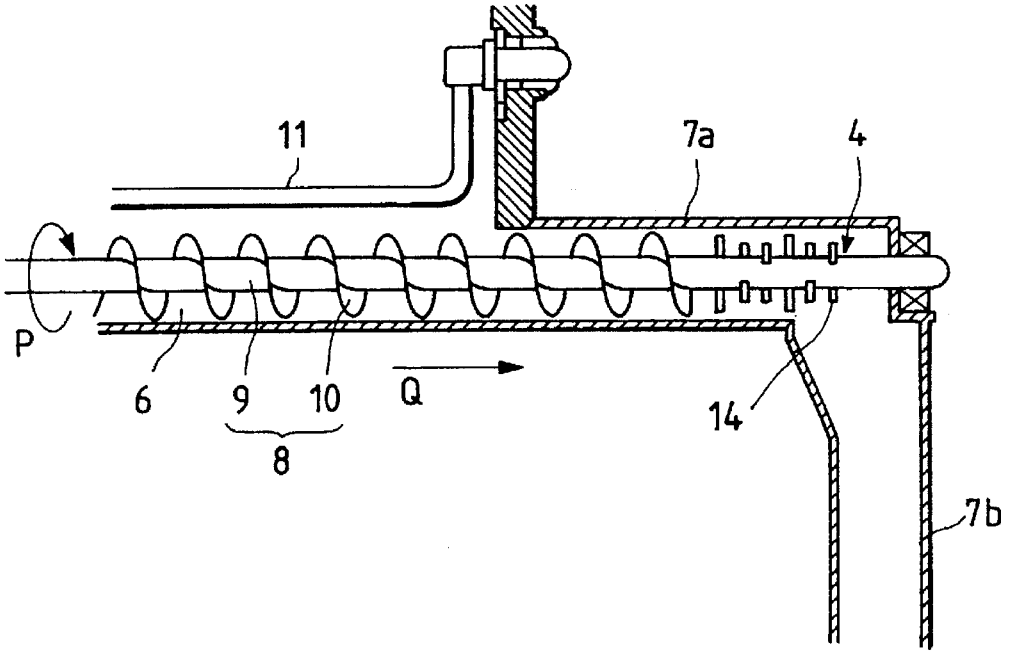
FIG. 2 is an enlarged, cross sectional view showing a key portion indicated by a circle A in FIG. 1.

Of FIGS. 1 and 2 showing an embodiment of the present invention, FIG. 1 is a partial cross sectional view showing a developing unit provided with a toner transporting device according to an embodiment of the present invention, and FIG. 2 is an enlarged, cross sectional view showing a key portion indicated by a circle A in FIG. 1. The toner transporting device of this embodiment, as shown in FIG. 1, functions to transporting toner from a toner box 2 as a toner storage means into a developing unit 3. In this embodiment, a toner lump loosening means 4 of the toner transporting device uses a needle member as a loosening portion thereof.

In FIG. 1 (FIG. 2), reference numeral 5 designates an outer transport path located outside the toner transporting device. The outer transport path 5 includes a toner lead-out groove 6, formed on the bottom of the toner box 2, for collecting toner in the toner box 2 and discharging it outside, and a transport pipe 7 for transporting toner discharged from the toner box 2 to the developing unit 3. The transport pipe 7 includes an extended portion 7*a* extended outward from one end of the toner box 2 along the extension of the toner lead-out groove 6, and a falling part 7*b* allowing toner to naturally fall from the opening of the end of the extended portion 7*a* for its supply to the developing unit 3.

The toner lead-out groove 6 of the outer transport path 5 contains a transport auger 8, rotatably provided, for transporting toner 1, which is collected in the toner lead-out groove 6, from the toner box 2 to the transport pipe 7. The transport auger 8 includes a rotary shaft 9 and a spiral 10 spirally wound on the rotary shaft 9. The rotary shaft 9 is rotatably supported at the side wall of one end of the toner box 2 and the side wall of the extended portion 7*a* extended from the other end of the toner box. The transport auger 8, together with an agitating member 11, is driven to turn at given timings by a driver portion 12. The agitating member 11 is rotatably provided in the toner box 2.

The toner lump loosening means 4 is formed on a part of the transport auger 8 located within the extended portion 7*a* of the outer transport path 5. The toner lump loosening means 4 consists of an array of needle pieces 14 having little toner transporting capability, which are formed on the rear end part (located downstream) of the rotary shaft 9 of the transport auger 8 located within the extended portion 7*a* of the transport pipe.

Figure 3:
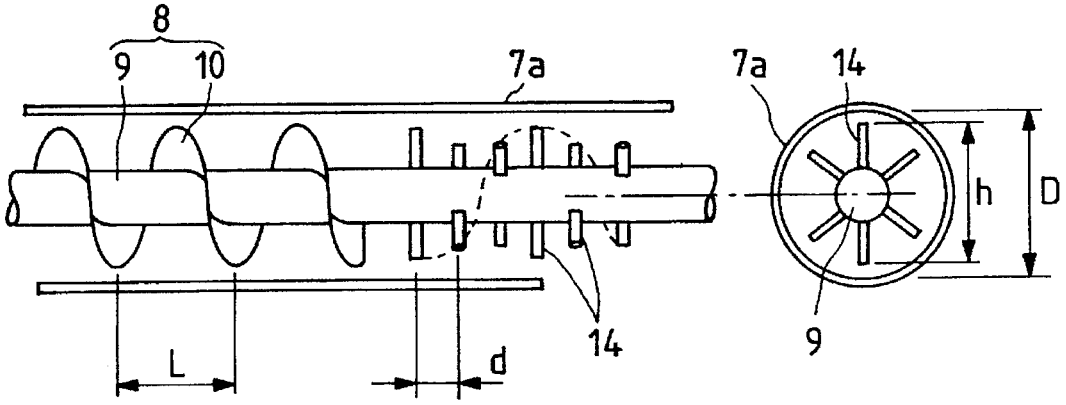
FIG. 3 is a sectional view showing the structure of a needle piece array in the developing unit shown in FIG. 1.

The needle piece array 14 consists of a plural number of needle piece standing upright on the rotary shaft 9 and arrayed such that the tips of the needle pieces are connected by a spiral dotted line as shown in FIG. 3. In the present embodiment, the needle piece array 14 is formed such that metal needle bars are passed through the rotary shaft 9 in a fashion that both ends are protruded from the rotary shaft.

The pitch d of the needle piece array 14 is shorter than the distance L of one cycle of the spiral 10. In the needle piece array 14, the needle pieces are arrayed in the direction opposite to the direction in which toner of the spiral 10 is transported by its turn, viz., the toner transporting direction.

A part of the needle piece array 14 is located within the tubular part of the extended portion 7*a* of the transport pipe. Further, the outer diameter h of the needle piece array 14 when it is turned is substantially equal to the inner diameter D of the tubular part of the extended portion 7*a*.

Of the transport pipe 7 of the outer transport path 5, the falling part 7*b* is connected to the toner supply port at one end of the developing unit 3, as shown in FIG. 1. An auger 15 for transporting and agitating toner is rotatably located within the developing unit 3. The auger 15 transports toner to a position just before the developing roll in the developing unit, through the transport pipe 7. The toner transporting path containing the auger 15 serves as an inner toner transporting path. In FIG. 1, the developing roll is indicated by a two-dot chain line and designated by reference numeral 16. The developing roll 16, the auger 15, and the like are driven to turn by a driver portion 17.

The operation of the thus constructed toner transporting device with the toner lump loosening means 4 will be described.

To form an image (develop a latent image) or to supply toner to the toner box 2, a toner supply signal is transferred from a controller means (not shown) to the driver portion 12. In response to the signal, the driver portion 12 drives the transport auger 8 and the agitating member 11 in the toner box 2 to turn. Toner 1 in the toner box 2 is transported to the transport pipe 7 while being agitated by the rotating agitating member 11. In this case, the spiral 10 of the transport auger 8 functions to transport toner through the toner lead-out groove 6 of the outer transport path 5. In FIG. 2, an arrow P indicates the rotating direction of the transport auger 8 and an arrow Q indicates the toner transporting direction of the transport auger 8.

Within the transport pipe 7, the toner lump loosening means 4 rotates which follows the rotation of the transport auger 8. The toner 1 transported to the transport pipe 7 undergoes the loosening action of the rotating toner lump loosening means 4. In other words, the toner within the tubular part of the transport pipe 7 is agitated while in contact with the needle piece array 14 of the rotating toner lump loosening means 4. As a result, soft blocking toner lumps are loosened into toner particles. It is noted here that since the toner lump loosening means 4 of the needle piece array 14 has little toner transporting ability, the toner 1 is sufficiently loosened while temporarily staying within the transport pipe 7 containing the toner lump loosening means 4.

The transport auger 8 progressively feeds the toner 1 into the transport pipe 7. The toner 1 within the transport pipe 7 with the toner lump loosening means 4 contained therein is successively moved forward the opening of the extended portion 7*a* of the transport pipe 7. The toner 1 that underwent the loosening action of the toner lump loosening means 4 is transported from the opening to the falling part 7*b*, and drops down therethrough and is transported to the developing unit 3. In the developing unit 3, the toner 1 is transported to a position just before the developing roll in the developing unit 16, while being agitated therein by the auger 15 rotated by the transport pipe 7. As a result, the developing unit 3 carries out the developing process using normal toner not containing the soft blocking toner lumps. The resultant image is free from black dots by the toner lumps.

It is noted that the needle piece array 14 is coaxial with the transport auger 8 within the transport pipe 7, and located at the rear end part of the transporting section (spiral) of the transport auger 8. With this structure, the toner lumps are efficiently loosened. In other words, a smooth toner transportation is secured and no reduction of the amount of the transporting toner takes place. For this reason, the toner lump loosening means 4 is suitable for the high speed developing unit which requires the transportation of a large amount of toner per unit time.

It is noted further that needle pieces of the needle piece array 14 are mounted at different angles on the rear end part of the rotary shaft, and the pitch of the needle pieces is shorter than the pitch of the spiral. With this structure, the amount of toner passing not contacting with the needle piece array 14 is a little reduced or prevented, and a reliable toner-lumps loosening effect is secured. This useful effect is further enhanced in a structure that the needle pieces of the needle piece array 14 are arrayed in the direction opposite to the toner transporting direction of the spiral 10.

In an additional advantageous structure of the present invention, a part of the needle piece array 14 is located within the tubular part of the extended portion of the transport pipe. Further, the outer diameter h of the needle piece array 14 is substantially equal to the inner diameter D of the tubular part of the extended portion 7*a*. With this structure, little amount of the toner passes not contacting with the needle piece array 14, so that the toner lumps can efficiently be loosened. In this case, when the outer diameter h of the needle piece array 14 is much smaller than the inner diameter D of the tubular part of the extended portion of the transport pipe 7, the amount of the toner passes not contacting with the needle piece array 14 is increased. On the other hand, when the outer diameter h of the needle piece array 14 is substantially equal to the inner diameter D of the tubular part of the extended portion of the transport pipe 7, toner enters gap between the tips of the needle piece array 14 and the inner surface of the tubular part of the extended portion of the transport pipe, and sticks to the inner surface. For this reason, great care must be taken in selecting the outer diameter h of the needle piece array.

To confirm the loosening effect by the toner lump loosening means an experiment was conducted by the inventors. A toner cartridge used was left for 12 hours at 50° C. The cartridge contained toner of 500 g. It was loaded into a new toner box. At this time, it was not shaken. In this state, 1000 number of images were formed. Formation of black dots on the resultant images was checked. For the vehicle of comparison, a conventional toner transporting device (referred to as a first conventional device) not having the toner lump loosening means and another toner transporting device (referred to as a second conventional device) in which a wire is stretched along the spiral 10 of the transport auger 8 were used. Similar tests were conducted using those devices. A total number of black dots formed of the first conventional device was substantially equal to that of the second conventional device. The total number of the generated black dots of the toner transporting device of the present invention was extremely small, ¼ or smaller as large as that of the conventional devices. From this fact, it is easily seen that the soft blocking toner lumps are reliably loosened by the toner transporting device of the present invention. In a normal use condition, the loosening effect by the toner transporting device of the invention is more reliable.

In the above-mentioned embodiment, the toner lump loosening means 4 is attached to the rotary shaft 9 of the transport auger 8. In this state, the toner lump loosening means 4 is turned together with the rotary shaft 9 at the same rotating speed. In an alternative shown in FIG. 4, the toner lump loosening means 4 is turned at a speed different from that of the turning of the transport auger 8.

Figure 4A:
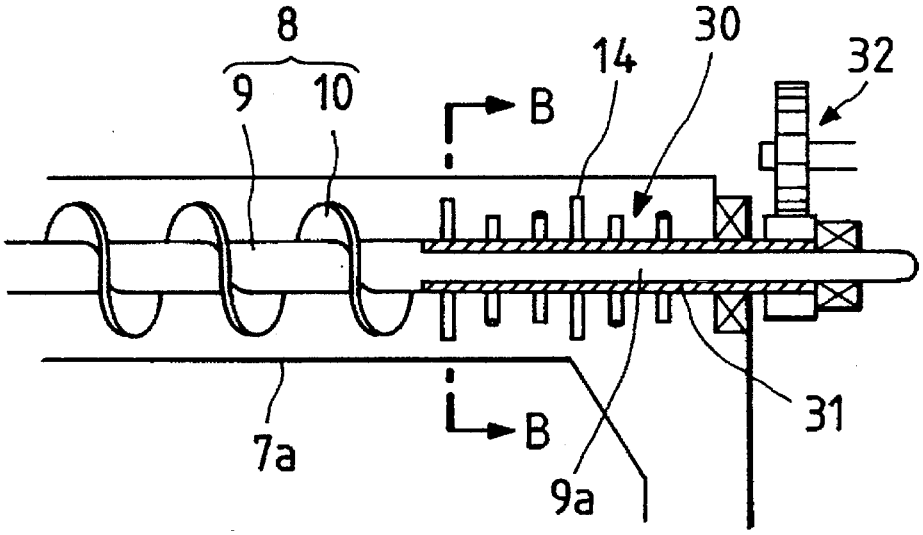
FIG. 4A and 4B are a construction of another needle piece array.
Figure 4B:
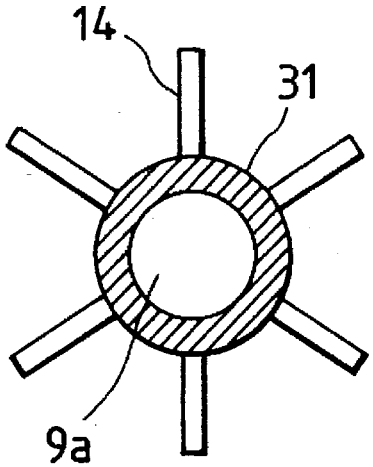

A toner lump loosening means 30 shown in FIG. 4 is constructed such that the needle piece array 14 is formed on a tubular rotary member 31 rotatably mounted on a rotary shaft 9*a* of the transport auger 8, and is driven by the driver portion 32 to turn about the rotary shaft 9*a*. In the construction of the toner lump loosening means 30, if the rotating speed of the toner lump loosening means 30 is set to be higher than that of the transport auger 8, the contact of it with toner of the needle piece array 14 is increased. Accordingly, the toner lump loosening means thus constructed further improves the toner lumps loosening effect than the structure where the toner lump loosening means 30 and the transport auger 8 are turned at the same speed. Incidentally, the rotating speed of the transport auger 8 cannot be varied since the amount of the transported toner must be fixed.

Figure 5:
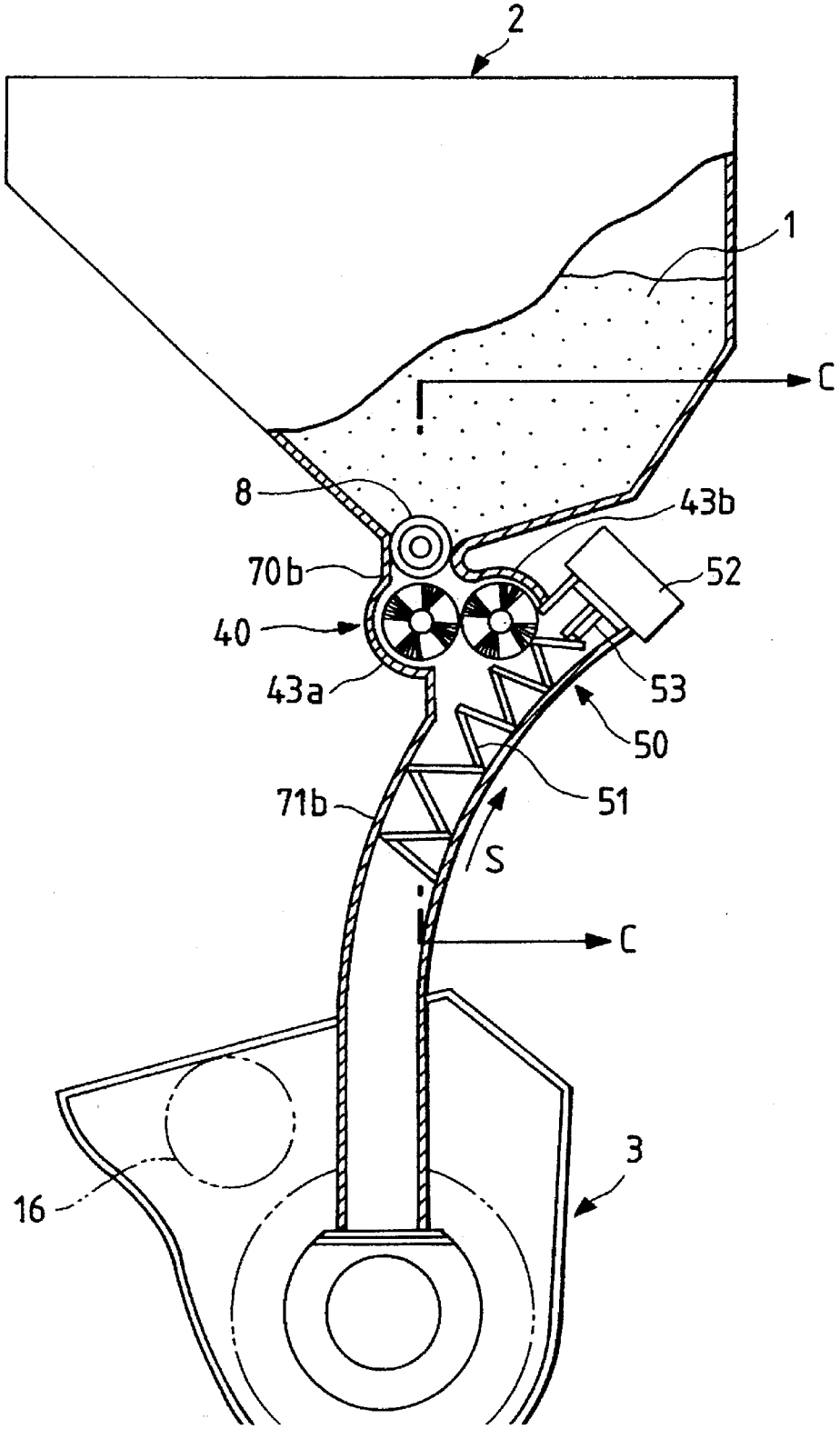
FIG. 5 is a partial cross sectional view showing a developing unit provided with a toner transporting device according to another embodiment of the present invention.
Figure 6:
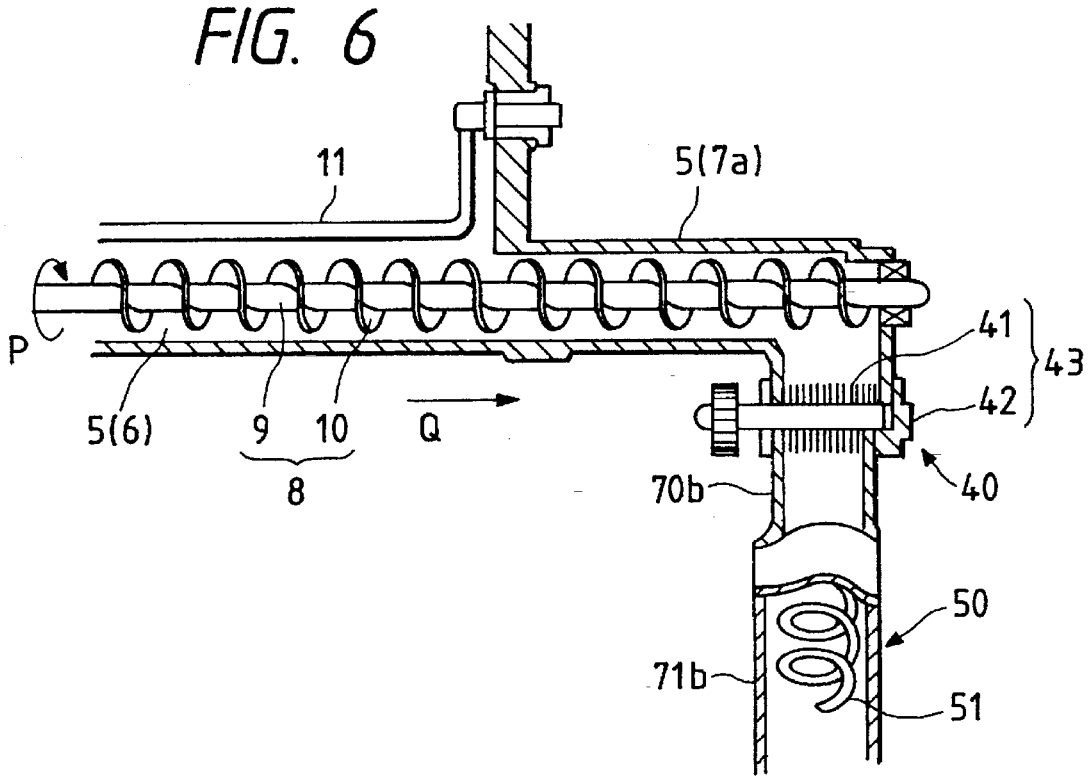
FIG. 6 is an enlarged, sectional view taken on line C—C in FIG. 5.

Turning now to FIGS. 5 and 6, there is shown a second embodiment of a toner transporting device according to the present invention. FIG. 5 shows a partial cross sectional view showing a developing unit with a toner transporting device according to another embodiment of the present invention. FIG. 6 is an enlarged, sectional view showing a key portion of the developing unit, the view being taken on line C—C in FIG. 5. The construction of the second embodiment is the same as that of the first embodiment in that a toner lump loosening means 50 of which the loosening structure includes a loosening portion 40 formed of bristles and a wire-like member, is used in place of the toner lump loosening means 4.

Figure 7:
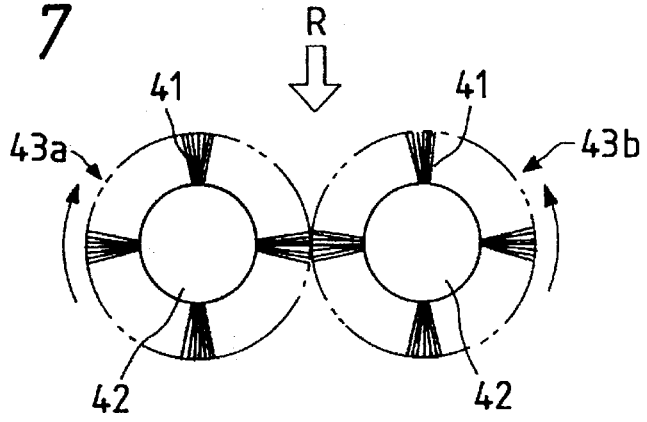
FIG. 7 is an explanatory diagram showing the construction of a brush loosening structure in the toner transporting device of FIG. 5.

The loosening portion 40 is constructed such that two brush rolls 43*a* and 43*b* are mounted side by side on the upper pipe 70*b* while being in contact with each other. Each of the brush rolls consists of bristles 41 planted at a predetermined density in a rotary shaft 42. The upper pipe 70*b* is formed at the rear part of the extended portion 7*a* of the outer transport path 5 in a state that it is bent downward. The two brush rolls 43*a* and 43*b* are driven by the driver portion for the transport auger 8 or a driver portion provided exclusively for driving the brush rolls so that the bristles 41 of the rolls, which face each other, move in the same direction as the direction (in the direction of an arrow R in FIG. 7) in which the toner 1 falls.

As in the first embodiment, the toner 1 in the toner box 2 is transported from the toner lead-out groove 6 of the toner transporting path is transported to the extended portion 7*a* by the rotating transport auger 8. Then, it drops down to the upper pipe 70*b*, from the opening of the extended portion 7*a*. When the toner 1 passes between the brush rolls 43*a* and 43*b*, soft blocking toner lumps contained in the passing toner are loosened. The toner lumps that drop down to the upper pipe 70*b* inevitably come in contact with the bristles 41 of the brush rolls, so that those lumps are loosened without fail.

Thus, in the loosening portion 40 of the second embodiment, the brush rolls are driven to turn so that the bristles 41 of the rolls, which face each other, move in the same direction as the falling direction of the toner. The toner is smoothly transported. When the two brush rolls 43*a* and 43*b* are turned at different speeds, toner particles contact with each other in a complicated fashion, so that the loosening effect by the rolls is further enhanced.

When the rotation of the brush rolls 43 is synchronized with the intermittent operation of the transport auger 8, the wearing of the bristles is more reduced than when those components are continuously turned. However, the brush rolls stop in state that the final toner intermittently transported that dropped down on the brush rolls 43, stay there. As a result, toner sticks to the brush or toner is left unsatisfactorily loosened in the initial state of the next rotation. For this reason, it is desirable that the brush rolls 43 are turned in association with the intermittent operation of the transport auger 8 and is stopped slightly after the auger is stopper.

In the construction of the toner lump loosening means 50 of which the loosening portion is formed of a wire-like member, a spirally shaped wire 51 is rotatably supported within a lower pipe part 71*b*, partially curved, that is connected to the bottom of the upper pipe 70*b* of the outer transport path 5. More specifically, one end of the spirally shaped wire 51 is fixed to a rotary shaft 53 of a driver portion 52, while the other end there is free. The spirally shaped wire 51 is so arranged that its spiral moving direction S is opposite to the toner transporting direction.

In the toner lump loosening means 50, the toner 1 which passes through the loosening portion 40, and drops down from the upper pipe 70*b* to the lower pipe part 71*b*, come in contact with the rotating spirally shaped wire 51 to be loosened.

Figure 8:
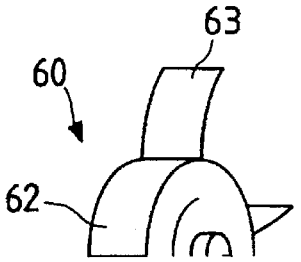
FIG. 8 is a perspective view showing an example of a toner lump loosening means with the blades made of elastic material.

FIG. 8 is a perspective view showing an example of the toner lump loosening means of which the loosening structure is constructed using elastic molded members. A toner lump loosening means 60 using elastic molded members is constructed such that a rotary body 62 with a rotary shaft 61 is provided with a predetermined number of elastically deformable blades 63 made of synthetic resin, rubber, or the like. Two toner lump loosening means 60 may be provided within the upper pipe 70*b*, in place of the brush rolls 43*a* and 43*b* of the second embodiment. Toner clumps are loosened while being in contact with the blades 63 which are rotating while being elastically deformed.

In the second embodiment, the loosening portion 40 and the toner lump loosening means 50 are both used. Alternatively, one of them may be used. Two or more number of loosening structures thus far described may be combined if required.

In the above-mentioned embodiments, the toner transporting device is located between the toner box and the developing unit. The toner transporting device of the present invention may be used for transporting toner from a cleaning unit for collecting residual toner to a developing unit. In this case, the toner transporting device loosens soft blocking toner lumps, toner lumps blocked by another cause, toner to be blocked into lumps or the like.

While the case where the toner lump loosening means 4 is provided in the outer transport path 5 has been described, the toner lump loosening means 4 may be placed at a predetermined location in the inner transport path, i.e., the transport path where the transport/agitating auger 15 is placed. Also in this case, the toner lump loosening means 4 is normally operable for loosening the toner lumps.

As described above, in the toner transporting device of the present invention, a toner lump loosening means is movably placed at a predetermined location in the toner transporting path continuous to a position just before the developing roll within the developing unit. With this construction, soft blocking toner lumps can be loosed into toner particles (in the transporting path) before the toner lumps reach the developing roller of the developing device. Since the toner lump loosening means operates within the toner transporting path, it impedes the transporting of toner, and reliably loosens even the toner lumps of small diameters, such as soft blocking toner lumps. Accordingly, the toner transporting device of the present invention eliminates black dots caused by the soft blocking toner lumps. The present invention succeeds in eliminating deterioration of the image quality caused by the toner lumps, which is inevitable for the conventional art.

The loosening structure of the toner lump loosening means may be constructed with needle pieces, bristles, wire-like member, elastic molded members or the like. Accordingly, the manufacturing of it is easy. It may be assembled into the toner transporting path without great increase of cost.

What is claimed is:

1. A toner transporting and loosening device for transporting toner to a developing unit by way of a toner transporting path, comprising:

a shaft having a spiral portion and a non-spiral portion, and a toner lump loosening means for loosening soft blocking toner lumps, said loosening means being movably located in an outer transport path contiguous to a developing unit and including loosening portions mounted on the non-spiral portion of said shaft.

2. The toner transporting and loosening device of claim 1, wherein said loosening portions are mounted at different angles on said shaft.

3. The toner transporting and loosening device of claim 1, wherein the pitch of said loosening portions are shorter than the pitch of the spiral of said shaft.

4. The toner transporting and loosening device of claim 1, wherein said loosening portions are arrayed in the direction opposite to the toner transporting direction of the spiral of said shaft.

5. The toner transporting and loosening device of claim 1, wherein the outer diameter of said loosening portion is substantially equal to the inner diameter of said outer transport path.

6. The toner transporting and loosening device of claim 1, wherein said loosening portions are an array of needle pieces.

7. The toner transporting and loosening device of claim 1, wherein said loosening portions are bristles.

8. The toner transporting and loosening device of claim 1, wherein said loosening portions are wire-like members.

9. The toner transporting and loosening device of claim 1, wherein said loosening portions are elastic molded members.

10. The toner transporting and loosening device of claim 9, wherein said elastic molded members are selected from a group of synthetic resin, and synthetic rubber.

* * * * *